United States Patent [19]

Wilsford, deceased

[11] Patent Number: 4,521,043

[45] Date of Patent: Jun. 4, 1985

[54] TRASH BAGGING APPARATUS

[75] Inventor: Robert L. Wilsford, deceased, late of Fort Worth, Tex., by JoAnn Wilsford, executor

[73] Assignee: Jo Ann Wilsford, Fort Worth, Tex.

[21] Appl. No.: 609,310

[22] Filed: May 11, 1984

[51] Int. Cl.[3] ..... A47F 13/06; A47L 13/52

[52] U.S. Cl. ..... 294/19.1; 294/19.1

[58] Field of Search ..... 294/1 R, 19 R, 55, 93, 294/97, 99 R; 248/95, 97, 98, 99, 100, 101; 15/104.8, 257.1, 257.3, 257.4, 257.5, 257.7, 257.8, 257.92; 383/34, 33, 119

[56] References Cited

U.S. PATENT DOCUMENTS 3,936,087 2/1976 Alexander ..... 294/1 R 4,064,969 12/1977 Black ..... 248/99

*Primary Examiner*—James B. Marbert

*Attorney, Agent, or Firm*—Wofford, Fails & Zobal

[57] ABSTRACT

Trash bagging apparatus for facilitating emplacing trash in a flexible container comprising two flat side sheets hingedly connected together at their interior edges, their exterior edges free to be pivoted about the hinged connection for carrying or storage, or opened up to engage a flexible container for trash or the like, at least one of the flat side sheets being adapted to lie flat on the ground for having trash swept thereinto; and biasing spring strip for biasing the exterior edges toward their extremities so as to hold a flexible container onto the bottom of the trash bagging apparatus. Also disclosed are respective improvements; such as, a handle for carrying the side sheets, front and rear bag holders for holding the top of a trash bag, and a preferred embodiment in which the trash bagging apparatus is formed from a single substantially planar plastic sheet.

7 Claims, 7 Drawing Figures

TRASH BAGGING APPARATUS

FIELD OF THE INVENTION

This invention pertains to means facilitating bagging trash in flexible containers. More particularly, this invention pertains to new and useful means facilitating the sweeping of trash onto a device and transferring the trash easily into a plastic trash bag or the like.

BACKGROUND OF THE INVENTION

The conventional plastic trash bag, normally formed of thin, flexible, plastic, such as low density polyethylene, has come into widespread usage, both around the home and in trash pick-up services such as city garbage collections services. The widespread acceptance and use of such flexible plastic trash bags evidence their basic practicality notwithstanding the difficulty of filling the flexible and flaccid bags with trash.

One of the more common uses of the plastic trash bag, particularly in the larger sizes, is the collection of leaves, lawn and garden clippings and the like. The flexible bags are less than completely convenient in this type of environment and the prior art has seen the development of many types of holding devices for retaining the bags; and, particularly, the mouth thereof open in order to receive the debris, or trash to be put thereinto.

The following United States patents were turned up in a pre-examination search and illustrate the typical approaches taken by the prior art in solving this problem. U.S. Pat. No. 3,278,969 describes a foldable dust pan. U.S. Pat. No. 3,449,786 also describes a foldable dust pan that is slightly different in structure. U.S. Pat. No. 3,917,333 describes a sanitary scoop that is, in effect, a "pooper scooper", or sanitary scoop, that enables capturing canine defecation where required. U.S. Pat. No. 3,936,087 describes a relatively expensive and complicated collection receptacle involving a plurality of pieces for holding a plastic bag around a cylindrical container with a partial cylindrical scoop having substantially similar cylindrical configuration for dumping trash within the cylindrical container and any bag suspended therewithin. Such a structure would be very expensive and not be readily available to the ordinary homeowner because of the expense. Moreover, it is complex to assemble and not readily amenable to taking away a full bag of trash and emplacing a new empty bag thereon. U.S. Pat. No. 4,037,778 describes a universal bag support that has to be inserted deeply within the bag and comprises free standing, upright, bendable partitions that make difficult holding a conventional bag in place and requires too much effort to insert the side panels all the way to the bottom to protect the sides of the bag. U.S. Pat. No. 4,052,764 describes apparatus for stretching a bag over a box with a ramp to hold the bag open for sweeping the trash into the bag. There is no easy sweeping of the trash onto one planar side with a dumping option for dumping it into the bag as in this invention.

The last two patents turned up by the pre-examination search are probably the most pertinent and the last one cites the penultimate one. U.S. Pat. No. 4,193,157 is cited in U.S. Pat. No. 4,312,531 as having a plastic hoop inserted into the open mouth of the bag with a ramp provided in the outgoing extended relationship to the hoop for inward guiding of swept debris. The last patent, No. 4,312,531 also describes several other proposals for stabilizing plastic bags; such as, U.S. Pat. Nos. 2,384,709; 3,915,329; 3,917,107; and 3,945,314. That patent also cites very early patents such as Nos. 112,727 and 1,167,782 for engaging mouths of bags to hold them open.

From the foregoing, it can be seen that none of the prior art has been totally satisfactory in providing an economical structure that facilitates sweeping leaves, trash, dirt onto a planar surface that can be simply stood up to dump the trash into a flexible container; that can be carried readily in a planar configuration with the sides folded together and that can be easily slipped into a thin storage position in a planar configuration when not in use.

SUMMARY OF THE INVENTION

Accordingly, it is an object of this invention to supply an economical structure that facilitates sweeping of trash onto a planar side panel and dumping it into a plastic container held about its bottom end; that can be carried in a substantially planar structure; and that can be stored as a planar structure in a very thin position, as along a garage wall or the like.

It is a specific object of this invention to provide a structure that is substantially planar, but that can be bent into a position effecting a planar side for lying on the ground and sweeping trash thereonto and that can be stood into a vertical or semi-vertical position to dump the trash into a trash bag, and yet that obviates the disadvantages of the prior art.

These and other objects will become apparent from the descriptive matter hereinafter, particularly when taken into conjunction with the appended drawings.

In accordance with this invention there is provided trash bagging apparatus for facilitating emplacing trash in a flexible container, comprising:

a. two flat side sheets hingedly connected together at their interior edges with their exterior edges free to be pivoted about the hinged connection to be moved together to form a planar structure and opened to engage a flexible container such as trash bag for trash or the like; and b. a biasing means for biasing the exterior edges toward their extremities to form a substantially planar structure, or engage a trash bag thereabout.

At least one of the side sheets is adapted to lie flat on the ground for having the trash swept thereonto. The side sheets are elongate to protrude upwardly from the trash container emplaced on their bottom. Also disclosed are specific preferred embodiments; such as, handle for carrying the sheets, bag holding means for holding the flexible bag on the bottom of the apparatus, a hinge that is formed by cutting a groove in a sheet of plastic, and a biasing means that is simply a band at one end of the structure for biasing toward its open position.

DESCRIPTION OF PREFERRED EMBODIMENT(S)

Figure 1:
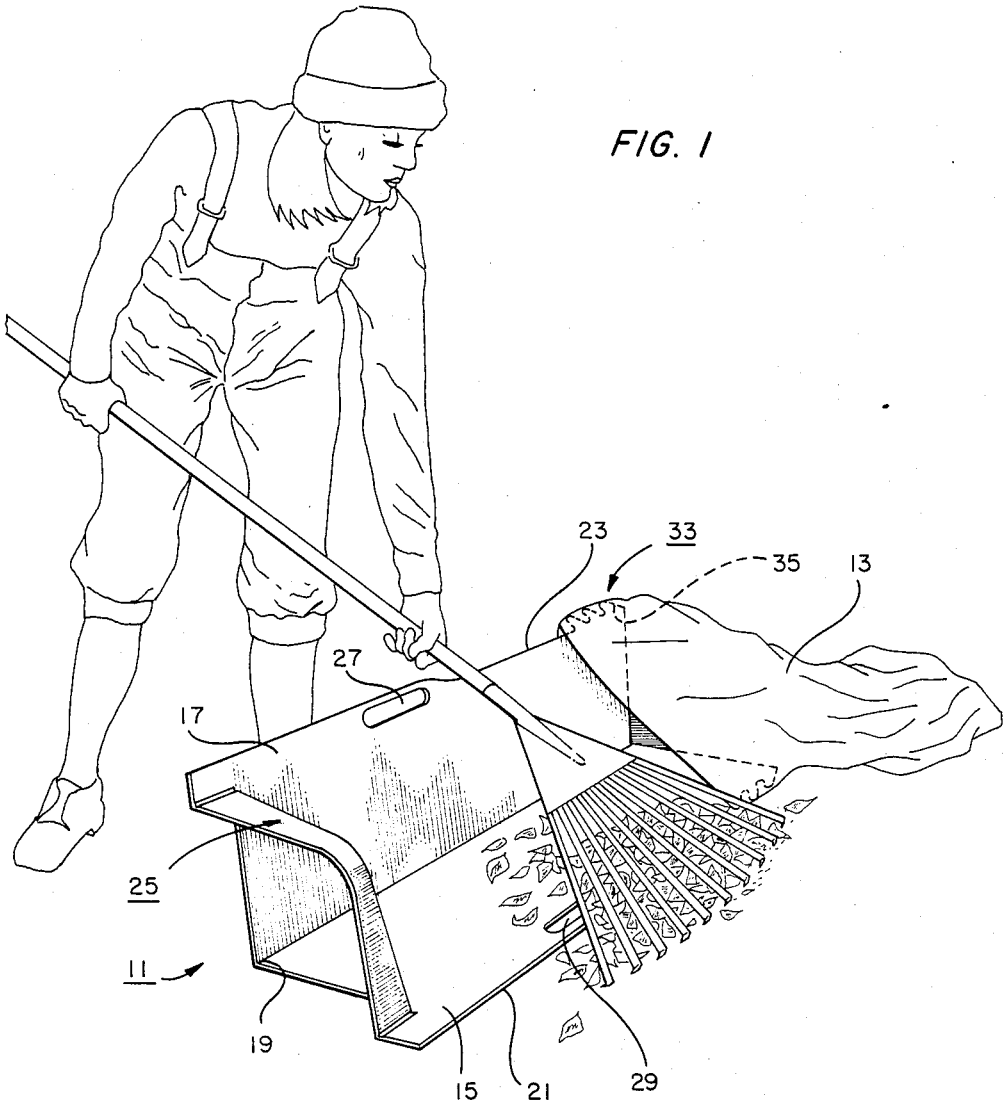
FIG. 1 is a perspective view of one embodiment of this invention being employed for raking leaves and loading them into a trash bag.
Figure 2:
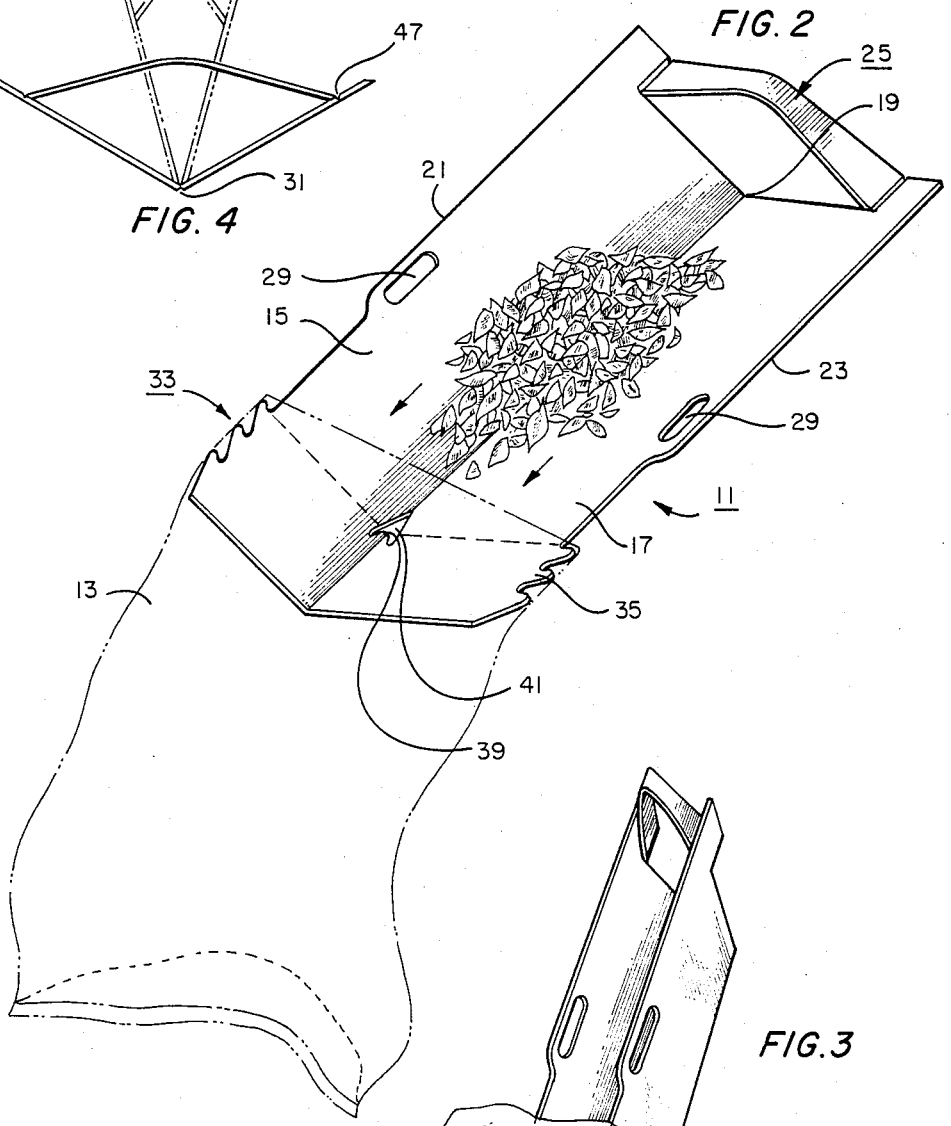
FIG. 2 is another view of the embodiment of FIG. 1 being elevated toward a vertical position to dump the leaves into the trash bag.
Figure 3:
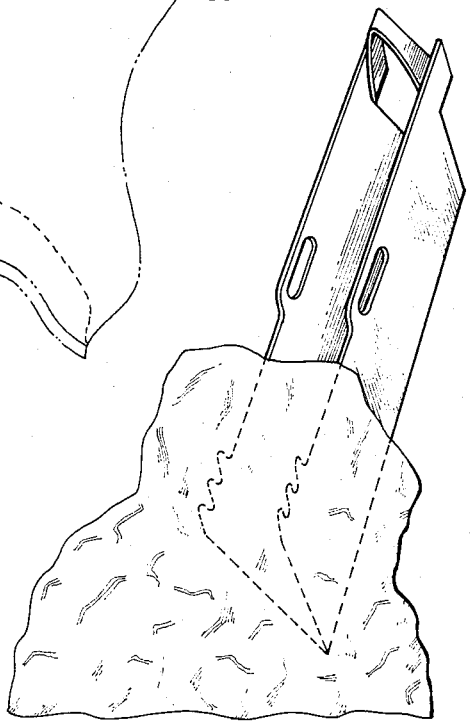
FIG. 3 is another view showing the collapsing of the apparatus of FIG. 2 after the leaves have been dumped and freeing up the apparatus from the flexible trash container.

Referring to FIG. 1, trash bagging apparatus 11 is being employed by a person raking leaves thereonto for depositing in a plastic trash bag 13. As can be seen, the flat side 15 lies flat and facilitates raking the leaves thereonto. Thereafter, the apparatus 11 merely has to be stood up toward the vertical position, as shown in FIG. 2 to deposit the leaves into the trash bag 13.

Specifically, the trash bagging apparatus 11 comprises two respective flat sides 15, 17 hingedly connected together at their interior edges 19 with their exterior edges 21, 23 free to be pivoted about the hinged connection to be moved together and opened so as to engage the flexible container for trash; and a biasing means 25 for biasing exterior edges 21, 23 toward their extremities. In the illustrated embodiment, the two sides and biasing means can form a planar structure in the fully open position so as to be readily stored alongside the wall of a garage or the like. At least one of the side sheets, such as side sheet 15, is adapted to lie flat on the ground for having the trash swept or raked thereonto, as illustrated in FIG. 1. Side sheets are elongate to protrude upwardly from the trash container emplaced on the bottom.

Preferably, a carrying means is provided for carrying the sheets. As illustrated, the carrying means comprises mating apertures 27, 29 that mate when folded together to form the handle for carrying sheets in a planar structure, although only one-half the dimensions of the unfolded planar structure. The respective apertures 27, 29 are disposed approximately midway of the longitudinal length to facilitate carrying.

The hinged connection 19 may take any form appropriate to the remainder of the structure. For example, if the flat sides are formed of plywood or the like, a piano hinge forms an excellent such hinged connection. In the illustrated embodiment, however, the flat sides are formed of plastic; such as $\frac{1}{8}$ inch to 3/16 inch thick high density polyethylene and the hinged connection comprises a small groove 31 cut on the back side but not cut entirely through such that the plastic, itself, forms the hinged connection.

While high density polyethylene is enumerated specifically as a plastic sheet that can be employed for making this invention, other thermoplastics such as ABS (acrylonitrile butadiene styrene), polypropolyene or similar thermoplastic materials can be employed as long as they are flexible in part and rigid in part.

Preferably, there is provided front bag holding means for holding the top of the flexible container onto a front near the bottom when the sheets are raised to dump trash into the flexible container. As illustrated, a front bag holding means 33 comprise a plurality of fingers 35 on the respective exterior edges adjacent the bottom for holding the trash bag thereonto. Yet, the trash bag is easily removed by simply lifting the bagging apparatus 11 out of the top of the trash bag after the trash has been dumped. It can be pivoted if desired, to remove the front first or it can be pivoted to remove the back first.

Preferably, there is also provided back bag holding means for holding the top of the flexible container on the back when the sheets are raised to dump trash into the flexible container. As illustrated, the back bag holding means may comprise any one of three approaches; namely, respective protrusions; a heart-shaped aperture cut away to provide a central support; and a plurality of fingers. These are illustrated respectively in FIGS. 5, 6 and 7. Specifically, as illustrated in FIG. 7, the back bag holding means comprise a plurality of protrusions 37 that protrude adjacent the interior edge of at least one of the flat side sheets. If desired, the protrusions can be provided on both sheets to further enhance the bag holding capabilities.

Figure 5:
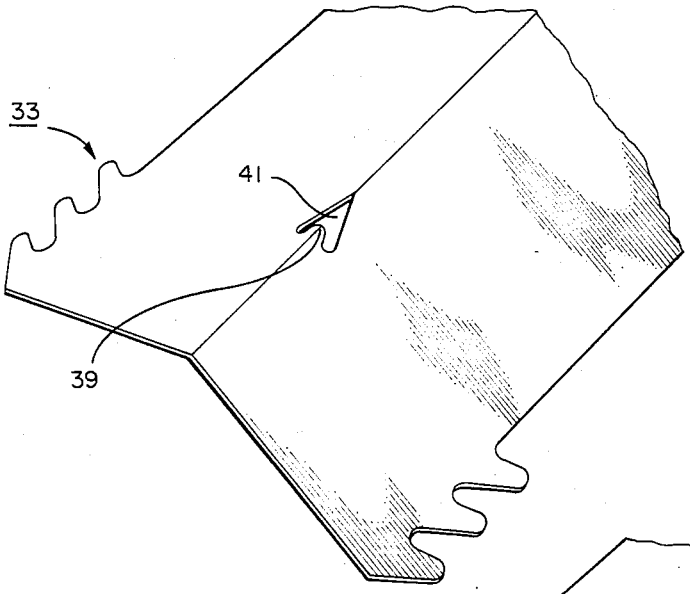
FIG. 5 is a partial isometric view showing an inverted heart-shaped rear bag holding means.

On the other hand, the back bag holding means may comprise an inverted, heart-shaped, cut-away aperture facilitating hanging the top of the flexible container on a central support protrusion 39, such as illustrated in FIGS. 2 and 5, the heart-shaped aperture being shown as 41.

Figure 6:
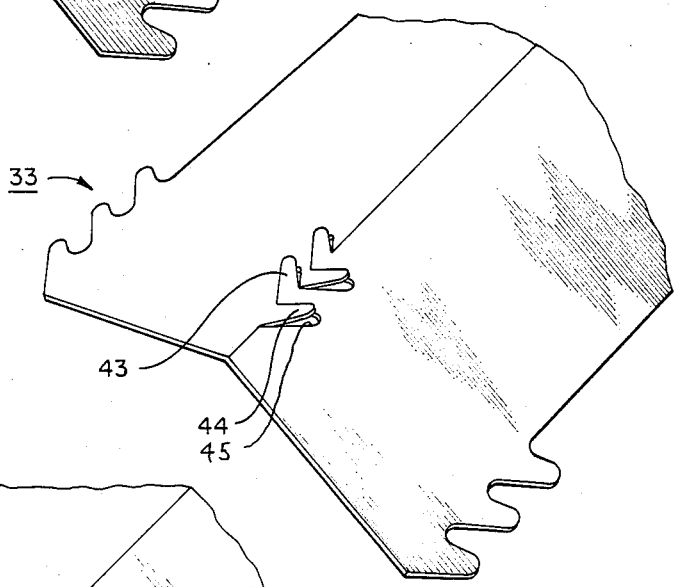
FIG. 6 is a partial isometric view of another embodiment of the rear bag holding means, showing the fingers.
Figure 7:
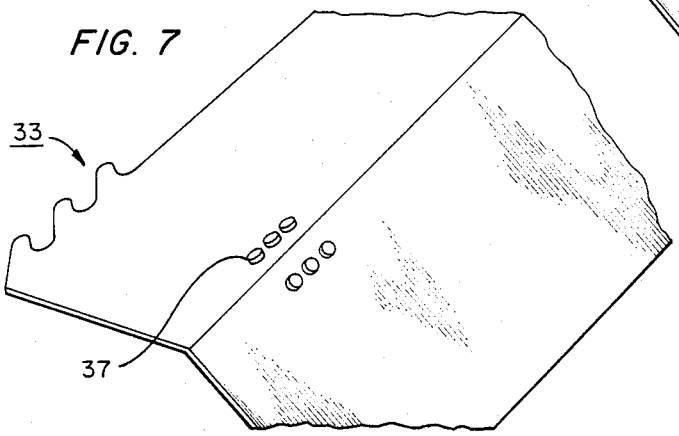
FIG. 7 is a partial isometric view showing protrusions for a rear bag holding means.

On the other hand, the back bag holding means may comprise a plurality of fingers 43, 44, FIG. 6, on at least one of the respective interior edges. As illustrated, the fingers 43, 44 are formed by cutting completely through an opposite side in a cut 45 such that the fingers 43 are co-planar with respective sides and are cut from opposite sides.

Figure 4:
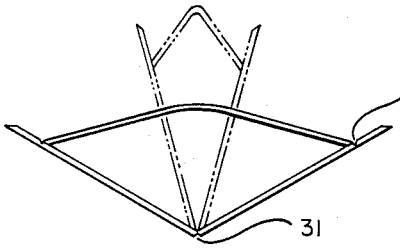
FIG. 4 is an end view showing the bending of the embodiment of FIG. 1.

As illustrated, the biasing means 25 comprises a biasing strip of plastic cut from the sheet and having front grooves 47, FIG. 4, cut at each end such that it can flex forwardly when the sheets are folded. Thus it has biasing force to bias the exterior edges 21, 23 away from each other. If, on the other hand, it is desired, a flex or wound spring can be employed with respective arms engaging the respective sides 15, 17 to bias them away from each other and pivot about the hinged connection 19. In any event, the biasing means will serve to try to open up the structure when the flat sides are folded together. This facilitates keeping a trash bag engaged with the bottom and dumping any trash thereinto.

In operation, as described hereinbefore with respect to FIG. 1, the trash bag is put onto the bottom of the trash bagging apparatus 11. If front and back bag holding means are employed, the bag is lifted up over the bag holding means to hold it in place. Thereafter, the trash container is laid with one side flat on the ground and the trash is raked or swept thereinto. Trash is dumped into the bag simply by elevating the trash bagging apparatus into the near vertical position to allow the trash to slide downwardly along the V-shape formed by the trash bagging apparatus 11 in this position and into the trash bag 13.

From the foregoing it can be seen that this invention satisfies the objects delineated hereinbefore. More particularly, this invention forms an economical, readily manufactured and used trash bagging apparatus that is available without the user being wealthy. More particularly, in the preferred embodiment described, the apparatus is economical such that it can be formed from a single sheet of planar plastic.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. Trash bagging apparatus for facilitating emplacing trash in a flexible container, comprising:

a. two flat side sheets hingedly connected together at their interior edges with their exterior edges free to be pivoted about the hinged connection to be moved together and to be opened up to engage a flexible container for trash or the like; at least one of the side sheets being adapted to lie flat on the ground for having the trash swept thereonto; said side sheets being elongate to protrude upwardly beyond the trash container emplaced on its bottom for a distance sufficient to have trash swept onto said side sheet; and b. biasing means for biasing said exterior edges toward their extremities in which position said hingedly connected sides form a substantially planar structure; said limit of travel of said side sheets being defined by the flexible container engaging the side sheets for receiving the trash when the side sheets are stood upwardly to dump the trash into the flexible container;

wherein there is provided front bag holding means for holding the top of the flexible container on the front of said side sheets when said side sheets are raised to dump trash into the flexible container.

2. The trash bagging apparatus of claim 1 wherein said front bag holding means comprises a plurality of fingers on respective exterior edges of said side sheets adjacent the bottom thereof for holding the flexible container onto the front of said side sheets.

3. Trash bagging apparatus of claim 1 wherein there is provided a back bag holding means for holding the top of the flexible container onto the back of said side sheets near the hinged connection when the side sheets are raised to dump trash into the flexible container.

4. The trash bagging container of claim 3 wherein said back bag holding means comprise a plurality of protrusion adjacent an interior edge of at least one of said flat side sheets.

5. The trash bagging apparatus of claim 3 wherein said back bag holding means comprises an inverted heart-shaped aperture defining an upwardly protruding center support that facilitates holding the top of the flexible container on said center support protruding upwardly into the cut-away aperture.

6. The trash bagging apparatus of claim 5 wherein said back bag holding means comprise a plurality of fingers on at least one of the respective said interior edges, the fingers being formed by being completely cut through and out of the adjacent side sheet.

7. The trash bagging apparatus of claim 1 wherein said biasing means comprises a biasing strip of plastic formed by being cut through said sheet near the top and having front grooves cut in each end such that it can flex forwardly when said sheet is folded and thereby bias said exterior edges away from each other.

* * * * *